US006667487B1

(12) United States Patent
Sims, III et al.

(10) Patent No.: US 6,667,487 B1
(45) Date of Patent: Dec. 23, 2003

(54) RADIO FREQUENCY TRAP FOR CONTAINMENT OF PLASMAS IN ANTIMATTER PROPULSION SYSTEMS USING ROTATING WALL ELECTRIC FIELDS

(75) Inventors: William Herbert Sims, III, Decatur, AL (US); James Joseph Martin, Huntsville, AL (US); Raymond A. Lewis, Boalsburg, PA (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 0 days.

(21) Appl. No.: 10/361,034

(22) Filed: Jan. 31, 2003

(51) Int. Cl.[7] ..... H05H 13/00; H05H 15/00

(52) U.S. Cl. ..... 250/493.1; 250/503.1; 250/281; 250/292; 250/423 R; 376/127

(58) Field of Search ..... 250/493.1, 503.1, 250/281, 292, 423 R; 376/127

(56) References Cited

U.S. PATENT DOCUMENTS

| | | | | |
|---|---|---|---|---|
| 4,540,884 A | | 9/1985 | Stafford et al. | |
| 4,710,625 A | * | 12/1987 | Kelly | 250/305 |
| 5,469,323 A | | 11/1995 | Kanayama | |
| 5,561,291 A | | 10/1996 | Kelley et al. | |
| 5,629,519 A | | 5/1997 | Palermo | |
| 5,734,162 A | | 3/1998 | Dowell | |
| 6,035,805 A | * | 3/2000 | Rust | 118/723 VE |
| 6,124,592 A | | 9/2000 | Spangler | |
| 6,297,500 B1 | | 10/2001 | Franzen et al. | |
| 6,414,331 B1 | | 7/2002 | Smith et al. | |

* cited by examiner

*Primary Examiner*—Nikita Wells
(74) *Attorney, Agent, or Firm*—James J. McGroary; Istrate Ionescu

(57) ABSTRACT

A containment apparatus for containing a cloud of charged particles comprises a cylindrical vacuum chamber having a longitudinal axis. Within the vacuum chamber is a containment region. A magnetic field is aligned with the longitudinal axis of the vacuum chamber. The magnetic field is time invariant and uniform in strength over the containment region.

An electric field is also aligned with the longitudinal axis of the vacuum chamber and the magnetic field. The electric field is time invariant, and forms a potential well over the containment region. One or more means are disposed around the cloud of particles for inducing a rotating electric field internal to the vacuum chamber. The rotating electric field imparts energy to the charged particles within the containment region and compress the cloud of particles.

The means disposed around the outer surface of the vacuum chamber for inducing a rotating electric field are four or more segments forming a segmented ring, the segments conforming to the outer surface of the vacuum chamber. Each of the segments is energized by a separate alternating voltage. The sum of the voltages imposed on each segment establishes the rotating field.

When four segments form a ring, the rotating field is obtained by a signal generator applying a sinusoidal signal phase delayed by 90, 180 and 270 degrees in sequence to the four segments.

25 Claims, 3 Drawing Sheets

RADIO FREQUENCY TRAP FOR CONTAINMENT OF PLASMAS IN ANTIMATTER PROPULSION SYSTEMS USING ROTATING WALL ELECTRIC FIELDS

The invention described herein was made in the performance of work under a NASA contract NAS8-01078 and is subject to the provisions of Public Law 96-517 (35 USC 202) in which the contractor has elected not to retain title.

BACKGROUND OF THE INVENTION

1. Field of the Invention

This invention is directed towards the containment of charged particles using static and rotating magnetic and electric fields in a high vacuum.

2. Description of the Related Art

The containment of highly reactive charged particles cannot be done by using strictly mechanical means as contact between the walls of a containment vessel and the particles to be contained would destroy the containment vessel or annihilate the particle being contained. Instead of using mechanical means for containment of particles, electric and magnetic fields interacting with the charged particles are used to redirect the charged particles away from the containment vessel. Thus, containment with electric and magnetic fields depends on the electrical charge of the the particle to be contained. It is the electrical charge of the particle that reacts with electric and magnetic fields present within the containment vessel to redirect particle motion away from the walls of the containment vessel, preserving both the particle and the vessel. One example of reactive particles to be contained away from the walls of a containment vessel is antimatter, such as negatively charged antiprotons. A convenient experimental equivalent to antiprotons are their "normal matter" counter part, the hydrogen ion $H^+$, more readily available and less reactive.

Antiprotons are similar to protons, but have a −1 electrical charge, and a reversal of spin direction. The interest in containing antiprotons comes from the reaction of protons with antiprotons. This reaction has the highest potential specific energy density of any chemical or nuclear reaction, in the order of $10^8$ Mjoules/gram. Harnessing this concentrated energy in a matter-antimatter engine minimizes the amount fuel to be carried by a space craft. In order to benefit from the high energy density of this reaction, it is necessary to contain and manipulate antiprotons for delivery at proper times and quantities to the matter-antimatter engine for controlled energy release to be converted to thrust by the engine.

Antiprotons are contained in a cloud residing within a containment vessel. The cloud is a collection of negatively charged antiprotons. The antiproton cloud cannot approach the vessel walls because of the spontaneous antiproton reaction with protons, part of the atomic make-up of any containment vessel wall. Thus, the antiproton cloud has to be directed away from the containment walls using electric and magnetic fields that interact with the cloud using well known electromagnetic forces. The containment vessel has an internal ultra high vacuum to minimize proton anti-proton reactions with background gas molecules.

Certain terms are used to describe charged particles that react with magnetic and electric fields to alter their motion within these fields. A plasma is an ionized gas composed of ions and/or electrons.Ions are atoms, group of atoms, or molecule(s) that have acquired a net electric charge by gaining electrons or losing electrons.A $H^+$ ion, a proton, is a stable particle, having a positive +1 charge, in the Baryon family and a mass 1836 times that of an electron. Stripping a hydrogen atom of its electron will yield a positively charged (+1) proton, a preferred experimental substitute for an antiproton.

The containment of antiprotons has been discussed in the prior art. U.S. Pat. No. 6,414,331 to Smith et al. discusses a containment means for transporting and storing antiprotons, and is incorporated herein in its entirety by reference. The present invention improves over the '331 patent by facilitating longer charged particle containment times and densities.

Other patents, such as U.S. Pat. No. 4,540,884 to Stafford at al, U.S. Pat. No. 5,469,323 to Kanayama, and U.S. Pat. No. 5,629,519 to Palermo describe an apparatus for short term containment times of charged particles.

SUMMARY OF THE INVENTION

A containment apparatus for containing a cloud of charged particles comprises a cylindrical vacuum chamber having a longitudinal axis, and an outer surface. Within the vacuum chamber is a containment region. A magnetic field is aligned with the longitudinal axis of the vacuum chamber. The magnetic field is time invariant and uniform in strength over the containment region.

An electric field is also aligned with the longitudinal axis of the vacuum chamber. The electric field is time invariant, and forms a potential well over the containment region. One or more means are disposed around the cloud of charged particles for inducing a rotating electric field internal to said vacuum chamber. The rotating electric field imparts energy to the charged particles within the containment region and compresses the cloud of particles. The rotating electric field can also expand instead of compress the cloud of particles depending on its rotating direction.

The means disposed around the outer surface of the vacuum chamber for inducing a rotating electric field are four or more segments forming a segmented ring, the segments conforming to the outer surface of the vacuum chamber. Each of the segments is energized by a separate alternating voltage. The sum of the voltages establishes the rotating field.

When four segments form a ring, the rotating field is obtained by a signal generator applying a sinusoidal signal phase delayed by 0, 90, 180 and 270 degrees in sequence to the four segments.

DETAILED DESCRIPTION

This invention introduces the notion of applying phased, rotating AC signals superimposed on DC bias voltages to segmented rings to contain charged particles within an evacuated vacuum chamber.

Figure 1:
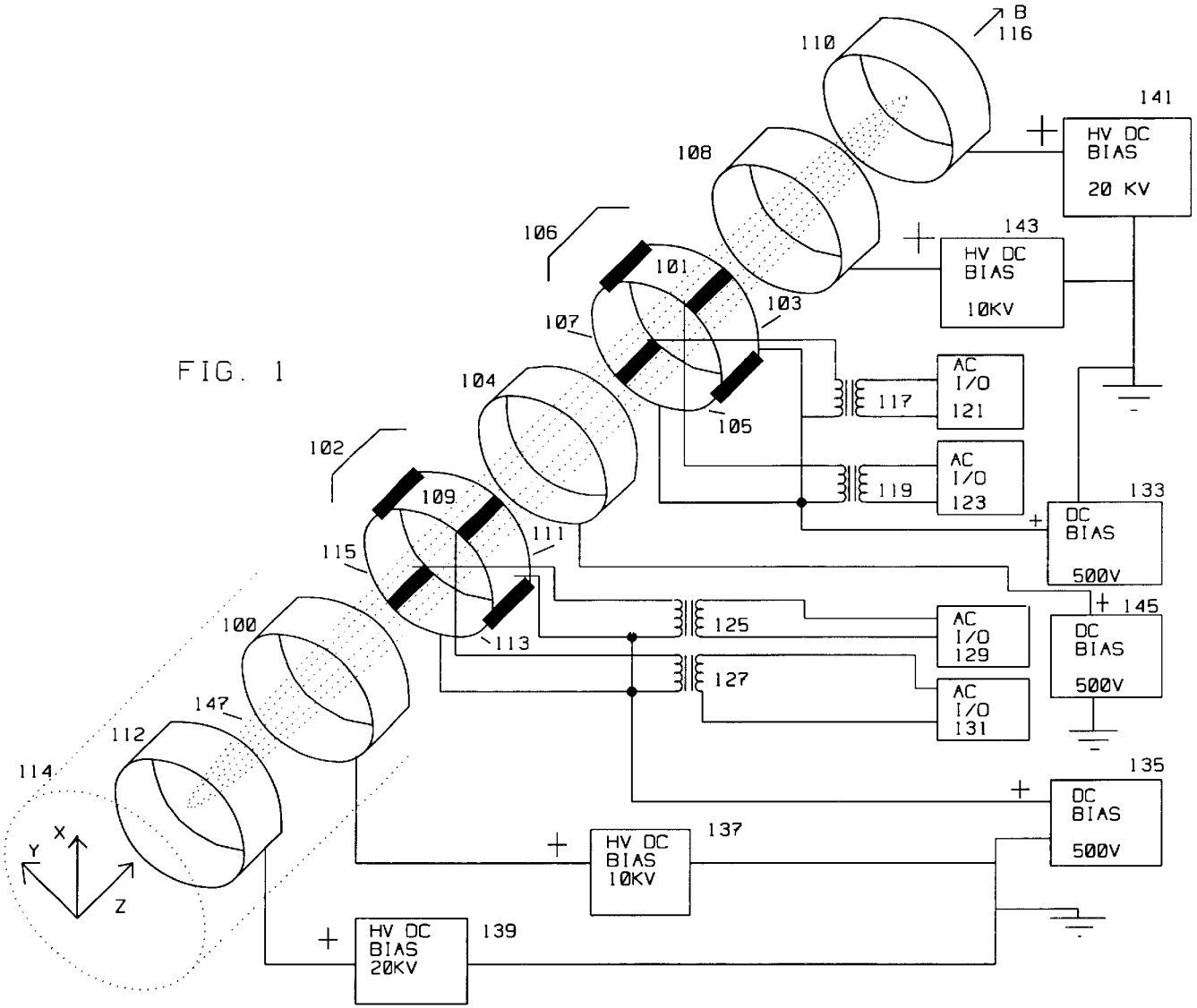
FIG. 1 is an exemplary implementation of the containment system of the present invention.

Shown in FIG. 1 is a preferred embodiment of a containment apparatus for containing a cloud of particles 147, such as protons ($H^+$) or anti-protons, each of said particles having an electrical charge. The electrical charge is positive (+1) for protons and negative (−1) for anti-protons. For the positive DC bias voltages shown in FIG. 1, the containment apparatus will confine positively charged particles such as positively charged protons. For antimatter proton containment, the DC bias supplies output a negative voltage of the same value instead of the positive voltage.

The containment apparatus for containing a cloud of particles 147 comprises a cylindrical vacuum chamber 114 having a longitudinal axis, and an outer surface. The outer surface or outer wall of the vacuum chamber is typically cylindrical, with a circular cross-section, having a diameter. It is made of a material transparent to electric and magnetic fields, such as, for example, glass. The cylindrical vacuum chamber contains within its volume an electrode structure that confines the cloud of particles within a containment region internal to the vacuum chamber. FIG. 1 shows the cloud of particles 147 confined to the containment region. The cloud of particles 147 occupy the same space as the containment region shown in FIG. 1. Therefore the containment region is the same as the cloud of particles 147.

One part of the containment mechanism is a magnetic field B, 116 aligned with the longitudinal axis of the vacuum chamber 114. Magnetic field 116 is time invariant and uniform over the containment region and oriented as shown.

A first (segmented) ring 102, a second ring 104 and a third (segmented) ring 106 are disposed in sequence along the longitudinal axis of the vacuum chamber 114. Rings 102, 104 and 106 are electrically insulated from each other and any conductive parts of the vacuum chamber, perpendicular to the longitudinal axis and centered about the longitudinal axis. They envelop the cloud of particles 147 to be contained within the vacuum chamber. The rings generally conform to the circular (inner) surface of cylindrical vacuum chamber 114.

The first segmented ring 102 has a plurality of segments typically four or more. Best mode of the invention calls for four first segments, 109, 111, 113 and 115. The four first segments are electrically insulated from each other and mechanically separate. All of the four first segments 109, 111, 113,115 are energized at a 500 VDC potential, a first time invariant voltage, supplied by DC (direct current) bias supply 135.

Second ring 104, unsegmented, is disposed between the first (segmented) ring 102 ring and the third (segmented) ring 106 along the longitudinal axis. This second ring 104 is mechanically separate from the first segmented ring 102 and the next, third (segmented) ring 106 along the longitudinal axis. The second ring 104 is energized at a second, time invariant DC voltage supplied by DC bias supply 145. Typically, the DC voltage applied to this second ring 104 is less than that applied to first ring 102 or third ring 106 to form the potential well shown in FIG. 3.

The third (segmented) ring 106 is disposed next to the second ring 104 along the longitudinal axis. This third ring 106 is mechanically separate from the second ring 104 along the longitudinal axis of vacuum chamber 114. The third ring 106 has a plurality of second segments, typically four or more second segments. Best more of the invention calls for four said second segments, 101, 103, 105, and 107, each electrically insulated from each other. The second segments are energized at a third time invariant voltage supplied by DC bias supply 133 at typically 500 VDC.

Figure 3:
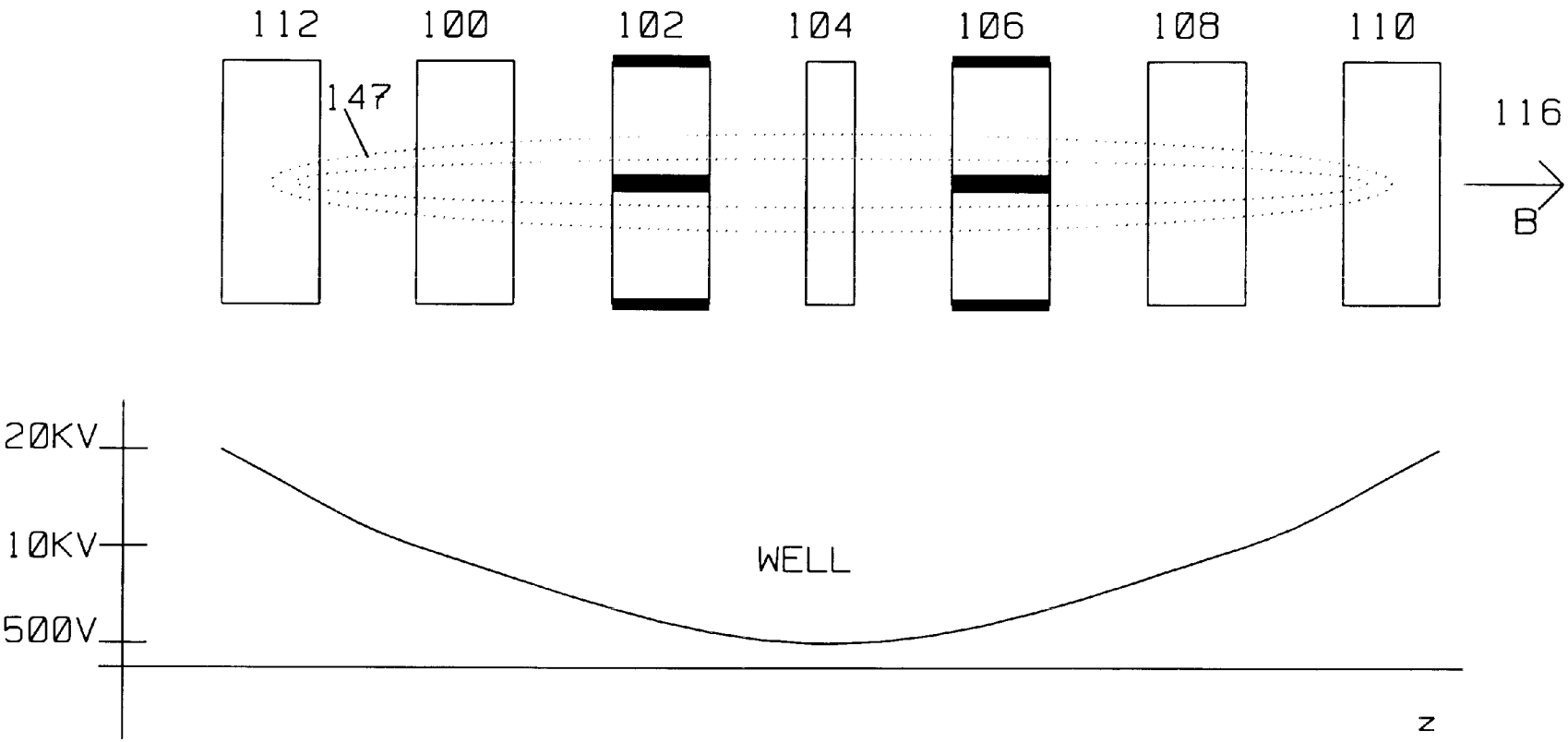
FIG. 3 is an exemplary potential well within the containment system of the present invention formed by the application of various voltages to separate rings part of the containment system described herein.

Rings 100, 112,108 and 110 work in conjunction with rings 102, 104 and 106 to create a time invariant first electric field aligned with the longitudinal axis. This first electric field forms a potential well around the containment region, as shown in FIG. 3. The potential well is spatially defined along the longitudinal axis of the vacuum chamber (the z axis) by the application of 10 KVDC to unsegmented ring 100 and ring 108 and 20 KVDC to unsegmented rings 112 and 110. The center of rings 112, 100, 108 and 110 are aligned with the longitudinal axis of vacuum chamber 114. Ring 112 is powered by high voltage bias supply 139 at 20 KVDC, while ring 110 is powered by high voltage bias supply 141 at 20 KVDC. Ring 100 is powered by high voltage bias supply 137 at 10 KVDC, while ring 108 is powered by high voltage bias supply 143 at 10 KVDC.

An alternating (AC) electrical signal producing a rotating wall electric field is applied to each of said first segments, 109, 111, 113 and 115 of ring 102. This alternating signal is superimposed on the first time invariant potential of 500 VDC supplied by DC Bias supply 135. Best mode is to supply 90 degree shifted signal pairs to the four segments. Transformer 127 energizes segment 109 and 113 of ring 102 with a sinusoidal voltage supplied by AC input/output unit 131. The voltage supplied to segment 109 is 180 degrees out of phase with respect to segment 113 by virtue of operation of transformer 127. Similarly transformer 125 energizes segments 111 and 115 of ring 102 with sinusoidal voltage supplied by AC input/output unit 129. The voltage supplied to segment 111 is 180 degrees out of phase with respect to segment 115 by virtue of operation of transformer 125. The AC signal generated from I/O 129 is 90 degrees phase shifted with respect to I/O 131. Therefore, for B 116 as shown, and using "normal matter" positively charged protons the phase sequence is:

Segment 109—0 degrees (no phase shift)

Segment 111—270 degrees

Segment 113—180 degrees

Segment 115—90 degrees

Generally, ring 102 is not energized to establish a rotating wall electric field at the same time as ring 106. However, when ring 106 is energized to establish a rotating wall electric field, in a similar manner, another alternating electrical signal is applied to each of second segments, 101, 103, 105 and 107 of ring 106. This alternating signal is superimposed on the first time invariant potential of 500 VDC supplied by DC Bias supply 133. Best mode is to supply 90 degree shifted signal pairs to the four segments. Transformer 119 energizes segment 101 and 105 of ring 106 with a sinusoidal voltage supplied by AC input/output unit 123. The voltage supplied to segment 101 is 180 degrees out of phase with respect to segment 105 by virtue of operation of transformer 119. Similarly transformer 117 energizes segments 103 and 107 of ring 106 with sinusoidal voltage supplied by AC input/output unit 121. The voltage supplied to segment 103 is 180 degrees out of phase with respect to segment 107 by virtue of operation of transformer 117. The AC signal generated from I/O 121 is 90 degrees phase shifted with respect to I/O 123. Therefore, for B 116 as shown, and using "normal matter" positively charge protons, the phase sequence for compressing the particle cloud is:

Segment 101—0 degrees (no phase shift)

Segment 103—270 degrees

Segment 105—180 degrees

Segment 107—90 degrees

Similarly, for antimatter, where particle charge is negative (−1), the phase sequence for compressing the particle cloud is:

Segment 101—0 degrees (no phase shift)

Segment 103—90 degrees

Segment 105—180 degrees

Segment 107—270 degrees

As indicated, the alternating electrical signal is applied to each of the first segments. Each segment receives a sinusoidal voltage of different phase thereby creating a second electric field, this second electric field has time dependent characteristics. This second electric field created by the AC signal induces motion in particles within the cloud, compressing the cloud of particles. The second electric field can be viewed as a "rotating wall" because the induced electric field from segments 109, 111, 113 and 115 rotates with respect to the stationary, time invariant electric potential field of all other electrodes, and the outer surface of vacuum chamber 114.

The first ring 102 has a first segment 109, a first segment 111, a first segment 113 and a first segment 115. These four segments are equally disposed along the outer surface of the cylindrical vacuum chamber 114 so that first segment 109, first segment 111, first segment 113 and first segment 115 each occupy in sequence approximately one quarter of the circumference of vacuum chamber 114.

Another function of the containment apparatus is to provide signal detector means for sensing signals (radio frequency energy) generated by the confined particle cloud. A first cloud signal is detected between first segment 109 and first segment 113. A second cloud signal is detected between first segment 111 and and first segment 115. The first cloud signal and the second cloud signal are alternating in nature and superimposed on the first time invariant potential supplied by DC bias source 135. Transformers 125 and 127 are bi-directional, that is, they will pass an AC signal from segments 109/113 and 111/115 to AC I/O 131 and AC I/O 129 respectively, as well as send energy into particle cloud 147.

The second segments 101, 103,105 and 107 can also be used to transmit or receive RF energy from the particle cloud, independently or in conjunction with the first segments. While the second segments are used to excite the particle cloud 147 using an input of RF energy, segments 109, 111,113, and 115 are used to detect signals from particle cloud 147. Transformers 117 and 119 are also bidirectional, coupling the signal from the particle cloud into AC I/O 121 and 123. The received electromagnetic signals generated by the cloud of particles, obtained from either the first segments or the second segments are connected to means for analyzing the received electromagnetic signals, such as a voltmeter, a spectrum analyzer, or digitizing means for storing the received signals.

Figure 2:
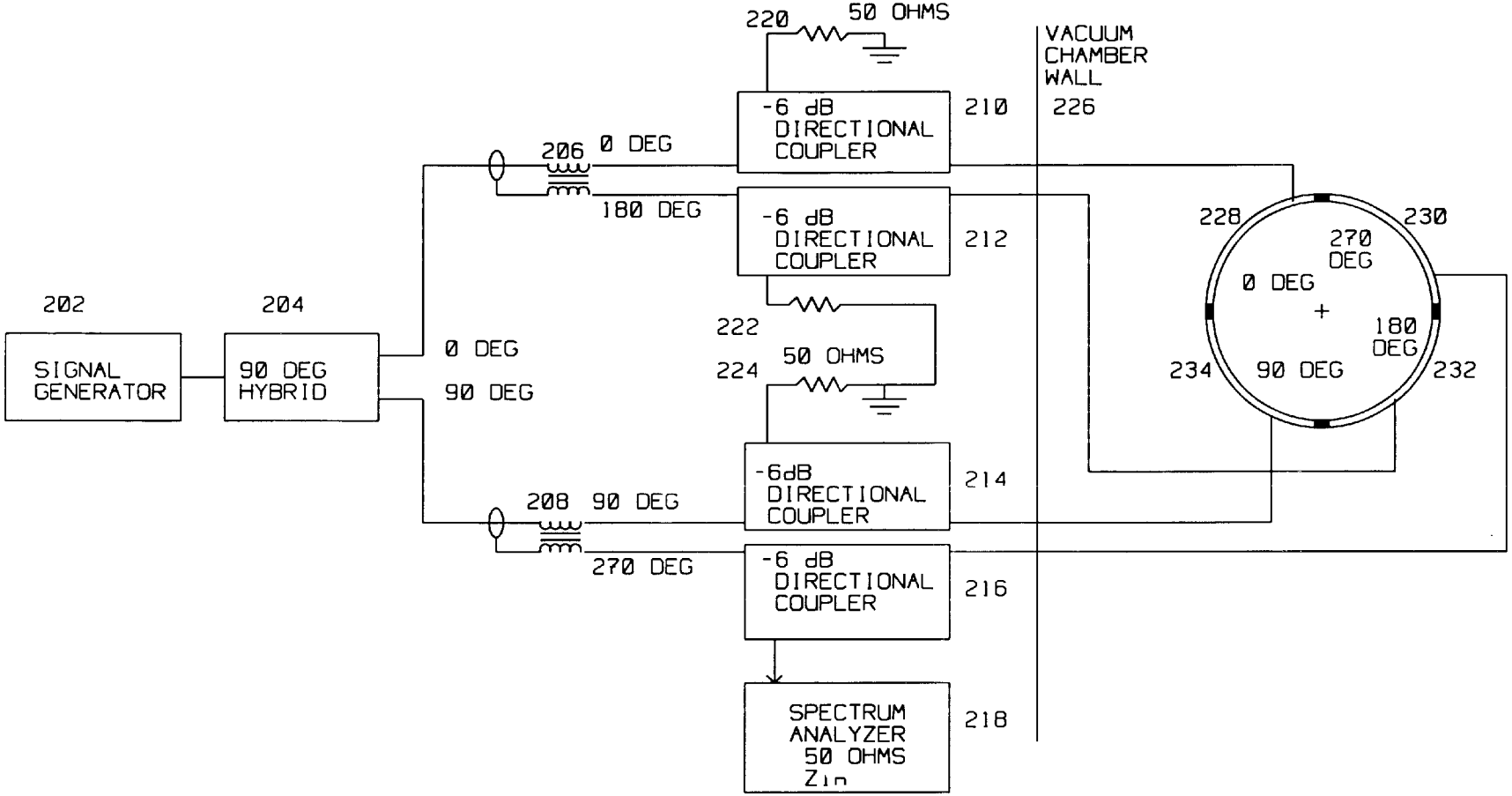
FIG. 2 is a detail of a segmented ring surrounding the particle cloud within the containment system herein and the circuitry for supplying an AC signal to the segments of the ring.

A preferred method for obtaining the AC signals for use with 4 segments such as 101, 103, 105 and 107 is outlined in FIG. 2. The elements of FIG. 2 are duplicated for rings 102 and 106. In FIG. 2, signal generator 202 supplies a 90 Degrees hybrid 204 with radio frequency energy. Thus, two, typically sinusoidal AC signals are formed, one 90 degrees of phase shifted from the other. The 0 degree signal is supplied to transformer (balun) 206, where an in phase (0 deg shift), and out of phase (180 deg shift) signal is generated. Similarly, the 90 degree signal from hybrid 204 is split by transformer (balun) 208 into a 90 degrees and a 270 degree signal.

Directional coupler 210 and 212 matches the 50Ω impedance to the output of the balun and reduces reflection for the 0 and 180 deg signal. Similarly, directional coupler 214 and 216 impedance matches the 90 deg and 270 deg signal. Directional coupler 216 connects to spectrum analyzer 218 having a 50 ohm impedance to allow signal analysis of signals emanating from the anti-proton cloud.

The order of magnitude of AC signals supplied to ring segments 101,103, 105 and 107 is in the order of 10 microvolts to 10 picovolts peak to peak. Because of the low voltage level involved, and possibility of interference, the conductors used are typically co-axial or tri-axial in structure, with proper shield grounding following established good radio frequency procedures. The wires internal to the vacuum chamber are typically either twisted pair, Kevlar covered for compatibility with the high vacuum ($10^{-11}$ Torr) within the chamber or coaxial. The twisted nature of the wires tends to minimize differential mode pick up of unwanted signals. Frequencies supplied by signal generator 202 are in the order of 6 Khz to 3 Mhz.

FIG. 3 shows a DC potential well formed by rings 112, 100, 102, 104, 106 108 and 110. The potential well is formed because the DC voltages supplied to the rings are higher (20 KV, rings 110 and 112) towards the ends of vacuum chamber, as shown in FIG. 1. The center of the vacuum chamber, rings 102, 104, and 106 are connected to 500 V DC supply, forming the lower portion of the potential well. The particle cloud is constrained within the potential well.

Method of Operation

Using above structure, the operation of the structure detailed in FIGS. 1, 2 and 3 is understood by considering the following mathematical derivation.

The equation of motion for a charged particle in a cloud present in a high vacuum within a containment vessel follows the familiar F×m a Newtonian concepts. Thus $$F=qv\times B+qE=ma \qquad \text{Eqn. 1}$$

where

F is the force exerted on a confined particle;

q is the charge on the particle (typically negative for an antiproton and positive for a proton)

v is the velocity of the particle within its trajectory;

B is the magnetic field aligned with the longitudinal axis of the cylindrical evacuated chamber 114;

E is the electric field also aligned with the longitudinal axis, and created by rings disposed along the circumference of the cylindrical evacuated chamber 114;

m is the mass of the particle;

a is the acceleration of the moving particle.

As shown in FIG. 1, B 116 is perpendicular to the plane of rings 112, 100, 102, 104, 106, 108 and 110. E is the gradient of potentials due to external electrodes and space charge forces among charged particles. For a region near the center of the assembly, at the center of ring 104, using $r=\sqrt{x^2+y^2}$ as the radius internal to vacuum chamber 114, the electrical potentials can be expressed as:

$$U_e=\frac{1}{2}k\left(z^2-\frac{r^2}{2}\right) \qquad \text{Eqn. 2}$$

where is z is aligned with B, and perpendicular to x and y, per FIG. 1.

Further, space charge in a spheroidal cloud, such as particle cloud 147, can be expressed as:

$$U_p = -\frac{m\omega_p^2}{6q}(ar^2 + bz^2) \quad \text{Eqn. 3}$$

The dimensionless numbers a and b are functions of $\omega_z$ and $\omega_p$ that describe the spheroidal shape of the particle cloud 147 contained in vacuum chamber 114. a and b obey the relationship 2a+b=3. This is described in more detail by Bollinger, J. J. et al, in *Physical Review A,* volume 48, number 1, page 525, July 1993 incorporated herein by reference in its entirety.

The motion of an ion can be written as a function of time (t):

$$x(t)=A\cos(\omega_+t+\phi_+)+B\cos(\omega_-t+\phi_-) \quad \text{Eqn. 4}$$

$$y(t)=A\sin(\omega_+t+\phi_+)+B\sin(\omega_-t+\phi_-) \quad \text{Eqn. 5}$$

and $$z(t)=C\cos(\omega_z t+\phi_z) \quad \text{Eqn. 6}$$

for low density clouds.

The "normal mode" frequencies, derived from Eqn 1, are given by:

$$\omega_\pm = \frac{\omega_c}{2} \pm \sqrt{\left(\frac{\omega_c^2}{4} - \frac{\omega_z^2}{2} - \frac{\omega_p^2}{2}\right)} \quad \text{Eqn. 7}$$

where $\omega_c$=qB/m is the cyclotron frequency;

$\omega_z$ is related to the particle mass spring constant k dependent upon the electric field strength in Eqn 2; and $\omega_p$ is the plasma frequency.

$$\omega_p = \left(\frac{\eta_o q}{\epsilon_o m}\right)$$

where $\eta_o$ is the plasma density of the particle cloud 147;

q is the charge on the charged particles, positive in the case of protons;

$\epsilon_o$ is the permittivity of free space (assumes a vacuum within vacuum chamber 114); and m is the charged particle mass.

$\omega_-$ frequency computed in Eqn 7 is used to compress the particle cloud using segments 101, 103, 105 and 107.

Depending on particle density and the other parameters shown in Eqn 7, the frequency of $\omega_\pm$ will range from 6 Khz to 3 Mhz.

For small region around the longitudinal axis of the containment vessel, in the center of ring 104, two types of drive are applicable from the four segments 101, 103, 105 and 107:

Quadruple drive $$U_Q=Qx\,y\cos(\omega t) \quad \text{Eqn. 8}$$

Rotating wall, forward and reverse:

$$U_\omega=W(x\cos(\omega t)\pm y\sin(\omega t)) \quad \text{Eqn. 9}$$

where, to a first order approximation $Q=VRF/r_r^2$ and $W=V_{RF}/r_r$.

$V_{RF}$ represents the amplitude of the AC voltage imposed on segment pairs 101/103 and 105/107, and $r_r$ is the radius of ring 106.

The same computation applies to ring 102 when used to inject RF energy into particle cloud 147.

In another embodiment, both segmented rings 102 and 106 are energized as indicated by Eqn 8 and Eqn 9 and FIG. 2.

The quantities computed in Eqn 8 and 9 are added to those of equation 2 and 3. However, to simplify the expressions, the quantities in Eqn 8 and 9 are treated as perturbations, linearly additive, and substantially (second order) smaller than $U_e$ of Eqn 2 and $U_p$ of Eqn 3.

The effect of the RF energy delivered in accordance with Eqn 8 and 9 are evaluated as time average torques and energy transfer.

The torque $\tau$imposed on a charged particle within the confined cloud is:

$$\tau=1/T\int_0^T r\times E_{RF}dt \quad \text{Eqn. 10}$$

The energy transfer $\Delta E$ is:

$$\Delta i\ E=1/T\int_0^T v\cdot E_{RF}{}^{dt} \quad \text{Eqn. 11}$$

$E_{RF}$ is the gradient of one of the potentials in equations 8 or 9, and v=dx/dt is the velocity of a charged particle within the containment volume.

In evaluating above integrals of Eqn 8 and 9, use the identity:

$$1/T\int_0^T \sin(\omega_1 t)*\sin(\omega_2 t)dt=½ \text{ for } \omega_1=\omega_2,\ 0 \text{ otherwise.} \quad \text{Eqn. 12}$$

Equation 12 is applicable in the limit as $T\rightarrow\infty$. Therefore it is good as a first order approximation where the integral covers many cycles, i.e. $T>>1/(2\pi\omega_1)$ The identity in Eqn 12 is applied to the rotating wall portion to terms such as W sin(ωt) sin($\omega_\pm$) that appear in equation 10 and 11. Thus, it can be concluded that the rotating wall has a cumulative effect on the cloud for RF frequencies $\omega=\omega_+$ or $\omega=\omega_-$.

For the quadruple drive, terms such as Q sin($\omega_+$t) cos($\omega_-$t) sin(ωt) occur in the torque and energy transfer. Such terms can be expressed in a form applicable to Eqn 12, by using the trigonometric identity:

$$\sin((\omega_+\pm\omega_-)t)=\sin(\omega_+t)\cos(\omega_-)\pm\sin(\omega_-t)\cos(\omega_+t) \quad \text{Eqn. 13}$$

Using above mathematical tools, the method for containing a cloud of particles using the hardware described in FIGS. 1, 2 and 3, is clarified. In accordance with the invention, each of the particles to be contained have an electrical charge and collectively form a cloud. The cloud of particles is contained by a method comprising the steps of:

applying a magnetic field aligned with a longitudinal axis of a cylindrical vacuum chamber having said longitudinal axis, and an outer surface, said vacuum chamber containing the cloud of particles within a containment region internal to the vacuum chamber, said magnetic field time invariant and uniform over said containment region and an electric field aligned with said longitudinal axis of said vacuum chamber and said magnetic field, said electric field time invariant over said containment region, said electric field forming a potential well over said containment region;

injecting the cloud of particles into said vacuum chamber;

separately energizing with an alternating voltage each of four or more segments of a ring disposed perpendicular to said longitudinal axis and centered about said longitudinal axis, and enveloping said cloud of particles contained within said containment region, said segments electrically insulated from each other and mechanically separate, said segments energized with a first time invariant voltage, said first time invariant voltage compatible with said electric field.

The alternating voltage energizing each of the first segments establishes a rotating electric field compressing the cloud of particles internal to the vacuum chamber.

The rotating field is obtained by supplying to each of said first segments a sinusoidal signal to segment 101, said signal phase delayed by 270 degrees to segment 103, said signal phase delayed by 180 degrees to segment 105 and said first signal phase delayed by 90 degrees to segment 107.

Segments 101, 103, 105 and 107 form segmented ring 106, ring 106 perpendicular to the longitudinal axis.

The alternating sinusoidal voltage applied to each of segments 101, 103, 105 and 107 has an amplitude between 10 picovolts and 10 microvolts peak to peak and a frequency ranging from 6 Khz to 3 Mhz for cloud of particles having a particle density of ranging from 1 per $cm^3$ to $10^{10}$ per $cm^3$.

All references cited in this document are incorporated herein in their entirety.

Although presented in exemplary fashion employing specific embodiments, the disclosed structures are not intended to be so limited. For example, although 4 segments are discussed for each ring 102, and 106, a plurality of 6, 8 or more segments are envisioned. Furthermore, while the rotating AC phase applied to the segments is shown identical, staggered every 90 degrees, it is envisioned that each ring may be slightly phase delayed with respect to the other to allow movement of the particle cloud from one position to the next along the axis of the vacuum chamber or to account for non-uniform motion and delays within the cloud. It is also envisioned that the cross section of the vacuum chamber may not be circular, but rather oval. This ovality of the vacuum chamber, in conjunction with a phase allocation different from the 0-90-180-270 degrees shown will produce a smooth application of energy over a larger cross section of the cloud, reducing the increased acceleration near the outer surface of the cylindrical vacuum chamber and lesser acceleration further towards the interior.

Those skilled in the art will also appreciate that numerous changes and modifications could be made to the embodiment described herein without departing in any way from the invention. These changes and modifications and all obvious variations of the disclosed embodiment are intended to be embraced by the claims to the limits set by law.

We claim:

1. A containment apparatus for containing a cloud of particles, each of said particles having an electrical charge, comprising:

a vacuum chamber having a longitudinal axis, and an outer surface, said vacuum chamber containing said cloud of particles within a containment region internal to said vacuum chamber;

a magnetic field aligned with said longitudinal axis of said vacuum chamber, said magnetic field time invariant and uniform over said containment region;

a first ring, a second ring, and a third ring;

said first ring, said second ring, and said third ring disposed in sequence along said longitudinal axis of said vacuum chamber, electrically insulated from each other, perpendicular to said longitudinal axis and centered about said longitudinal axis, and enveloping said cloud of particles to be contained within said vacuum chamber over said containment region;

said first ring having four or more first segments, said first segments electrically insulated from each other and mechanically separate, said first segments energized at a first time invariant voltage;

said second ring disposed between said first ring and said third ring along said longitudinal axis, said second ring mechanically separate from said first ring and from said third ring along said longitudinal axis, said second ring energized at a second time invariant voltage; and said third ring disposed next to said second ring along said longitudinal axis, said third ring mechanically separate from said second ring along said longitudinal axis, said third ring having four or more second segments said second segments electrically insulated from each other, said second segments energized at a third time invariant voltage, wherein said first ring, said second ring and said third ring create a time invariant first electric field aligned with said longitudinal axis, said first electric field forming a well around said containment region.

2. A containment apparatus as described in claim 1 wherein said first ring, said second ring, and said third ring generally conform to said outer surface of said vacuum chamber.

3. A containment apparatus as described in claim 2 wherein said vacuum chamber is cylindrical, said outer surface generally circular in cross-section, said outer surface having a circumference.

4. A containment apparatus as described in claim 3 wherein an alternating signal is applied to each of said first segments, said alternating signal superimposed on said first time invariant potential.

5. A containment apparatus as described in claim 4 wherein said alternating signal applied to each of said first segments has a different phase for each of said first segments thereby creating a second electric field, said second electric field having time dependent characteristics.

6. A containment apparatus described in claim 3, wherein said first ring has a first segment A, a first segment B, a first segment C and a first segment D, said first segment A, said first segment B, said first segment C and said first segment D, equally disposed along said outer surface of said cylindrical vacuum chamber so that said first segment A, said first segment B, said first segment C and said first segment D each occupy in sequence approximately one quarter of said circumference of said vacuum chamber.

7. A containment apparatus as described in claim 6 wherein a signal generator applies a sinusoidal first signal to said first segment A, said first signal phase delayed by 90 degrees to said first segment B, said first signal phase delayed by 180 degrees to said first segment C, and said first signal phase delayed by 270 degrees to said first segment D, said first signal superimposed on said first time invariant potential.

8. A containment apparatus as described in claim 6 wherein a signal detector senses a first cloud signal between said first segment A and said first segment C and a second cloud signal between said first segment B and said first segment D, said first cloud signal and said second cloud signal superimposed on said first time invariant potential.

9. A containment apparatus as described in claim 3 wherein said second segments receive electromagnetic signals generated by said cloud of particles, said second segments connected to means for analyzing said electromagnetic signals.

10. A containment apparatus as described in claim 9 wherein said means for analyzing said electromagnetic signals is a spectrum analyzer.

11. A containment apparatus for containing a cloud of particles, each of said particles having an electrical charge, comprising:

a vacuum chamber having a longitudinal axis, and an outer surface, said vacuum chamber containing said cloud of particles within a containment region internal to said vacuum chamber;

a magnetic field aligned with said longitudinal axis of said vacuum chamber, said magnetic field time invariant and uniform over said containment region;

an electric field aligned with said axis of said vacuum chamber, said electric field time invariant, said electric field forming a potential well over said containment region;

a ring disposed perpendicular to said longitudinal axis and centered about said longitudinal axis, and enveloping said cloud of particles contained within said containment apparatus;

said ring having four or more first segments, said first segments electrically insulated from each other and mechanically separate, said first segments energized at a first time invariant voltage, said first time invariant voltage compatible with said electric field.

12. A containment apparatus as described in claim 11 wherein an alternating voltage is applied to each of said first segments, said alternating voltage superimposed on said first voltage.

13. A containment apparatus as described in claim 12 wherein said alternating voltage applied to each of said first segments establishes a rotating electric field compressing said cloud of particles internal to said vacuum chamber.

14. A containment apparatus as described in claim 11 wherein said vacuum chamber is cylindrical, said outer surface is generally circular in cross-section, said outer surface having a circumference, and said ring generally conforming to said outer surface.

15. A containment apparatus as described in claim 14 wherein said ring has a segment A, a segment B, a segment C and a segment D, said segment A, said segment B, said segment C and said segment D, equally disposed along said outer surface of said cylindrical vacuum chamber so that said segment A, said segment B, said segment C and said segment D each occupy sequentially approximately one quarter of said circumference of said vacuum chamber.

16. A containment apparatus as described in claim 15 wherein a signal generator applies a sinusoidal first signal to said segment A, said first signal phase delayed by 90 degrees to said segment B, said first signal phase delayed by 180 degrees to said segment C, and said first signal phase delayed by 270 degrees to said segment D, said first signal superimposed on said first time invariant potential.

17. A containment apparatus as described in claim 15 wherein a signal detector senses a first cloud signal between said segment A and said segment C and a second cloud signal between said segment B and said segment D, said first cloud signal and said second cloud signal superimposed on said first time invariant potential.

18. A containment apparatus as described in claim 17 wherein said detector for analyzing said first cloud signal and said second cloud signal is a spectrum analyzer.

19. A containment apparatus for containing a cloud of particles, each of said particles having an electrical charge, comprising:

a cylindrical vacuum chamber having a longitudinal axis, and an outer surface, said vacuum chamber containing said cloud of particles within a containment region internal to said vacuum chamber;

a magnetic field aligned with said longitudinal axis of said vacuum chamber, said magnetic field time invariant and uniform over said containment region;

an electric field aligned with said axis of said vacuum chamber, said electric field time invariant, said electric field forming a potential well over said containment region;

a ring disposed perpendicular to said longitudinal axis and centered about said longitudinal axis, and enveloping said cloud of particles contained within said containment apparatus;

said ring having four or more first segments, said first segments electrically insulated from each other and mechanically separate, said first segments energized at a first time invariant voltage, said first time invariant voltage compatible with said electric field one or more means disposed around said cloud of particles for inducing a rotating electric field internal to said vacuum chamber, said rotating electric field imparting energy to said particles part of said cloud of particles within said containment region and compressing said cloud of particles.

20. A containment apparatus as described in claim 19 wherein said one or more means disposed around said outer surface for inducing a rotating electric field are four or more segments forming a segmented ring, said segments conforming to said outer surface.

21. A containment apparatus as described in claim 20 wherein each of said four or more segments are energized by a separate alternating voltage.

22. A containment apparatus as described in claim 21 wherein a signal generator applies a sinusoidal first signal to a segment A, said first signal phase delayed by 90 degrees to a segment B, said first signal phase delayed by 180 degrees to a segment C, and said first signal phase delayed by 270 degrees to a segment D, said segment A, said segment B, said segment C and said segment D forming said segmented ring, said segmented ring perpendicular to said longitudinal axis.

23. A method for containing a cloud of particles, each of said particles having an electrical charge comprising the steps of:

applying a magnetic field aligned with a longitudinal axis of a vacuum chamber having a longitudinal axis and an outer surface, said vacuum chamber containing said cloud of particles within a containment region internal to said vacuum chamber, said magnetic field time invariant and uniform over said containment region and an electric field aligned with said longitudinal axis of said vacuum chamber and said magnetic field, said electric field time invariant over said containment region, said electric field forming a potential well over said containment region;

injecting said cloud of particles into said vacuum chamber;

separately energizing with an alternating voltage each of four or more segments of a ring disposed perpendicular to said longitudinal axis and centered about said longitudinal axis, and enveloping said cloud of particles contained within said containment region, said segments electrically insulated from each other and mechanically separate, said segments energized with a first time invariant voltage, said first time invariant voltage compatible with said electric field, wherein said alternating voltage energizing each of said first segments establishes a rotating electric field compressing said cloud of particles internal to said vacuum chamber.

24. A method for containing a cloud of particles as described in claim 23, wherein said step of energizing said segments applies to each of said first segments a sinusoidal first signal to a segment A, said first signal phase delayed by 90 degrees to a segment B, said first signal phase delayed by 180 degrees to a segment C, and said first signal phase delayed by 270 degrees to a segment D, said segment A, said segment B, said segment C and said segment D forming said segmented ring, said segmented ring perpendicular to said longitudinal axis.

25. A method for containing a cloud of particles as described in claim 24, wherein said alternating voltage applied to each of said first segments has an amplitude between 10 picovolts and 10 microvolts peak to peak and a frequency ranging from 6 Khz to 3 Mhz for said cloud of particles having a particle density of ranging from 1 per $cm^3$ to $10^{10}$ per $cm^3$.

* * * * *